US010267303B2

(12) United States Patent
Verdugo et al.

(10) Patent No.: US 10,267,303 B2
(45) Date of Patent: Apr. 23, 2019

(54) HIGH VISCOSITY PORTION PUMP

(71) Applicant: Flow Control LLC., Beverly, MA (US)

(72) Inventors: Christopher H. Verdugo, Yorba Linda, CA (US); Bernard L. Perkins, Orange, CA (US); Humberto V. Meza, Trabuco Canyon, CA (US)

(73) Assignee: Flow Control LLC., Beverly, MA (US)

( * ) Notice: Subject to any disclaimer, the term of this patent is extended or adjusted under 35 U.S.C. 154(b) by 446 days.

(21) Appl. No.: 14/474,775

(22) Filed: Sep. 2, 2014

(65) Prior Publication Data

US 2015/0064025 A1 Mar. 5, 2015

Related U.S. Application Data

(60) Provisional application No. 61/871,903, filed on Aug. 30, 2013.

(51) Int. Cl.
*F04B 7/02* (2006.01)
*F04B 43/00* (2006.01)
(Continued)

(52) U.S. Cl.
CPC ..... *F04B 43/067* (2013.01); *F04B 43/0081* (2013.01); *F04B 43/073* (2013.01);
(Continued)

(58) Field of Classification Search
CPC .... F04B 43/073; F04B 43/0063; F04B 9/127; F04B 2201/0201; F04B 43/0081; F04B 43/067; F04B 49/03; F04B 49/065
(Continued)

(56) References Cited

U.S. PATENT DOCUMENTS 1,777,293 A 10/1930 Curtis et al.
2,711,134 A * 6/1955 Hughes ..... F04B 43/0054 417/395
(Continued)

FOREIGN PATENT DOCUMENTS

EP 0039146 11/1981
EP 0314209 5/1989
(Continued)

OTHER PUBLICATIONS

EP1613547 unavailable, published under WO 2004/091324.
EP0445231 unavailable, published under WO 90/05697.

*Primary Examiner* — Nathan C Zollinger
(74) *Attorney, Agent, or Firm* — Ware, Fressola, Maguire & Barber LLP

(57) ABSTRACT

A high viscosity portion pump system has a single piston portion pump having a piston/diaphragm assembly arranged on a piston shaft forming liquid and gas chambers, which moves from a starting-position and provides high viscosity fluid from the liquid chamber when gas is received by the gas chamber; has an elastic member arranged on a retainer coupled to the shaft in a compartment in a pump housing, which moves the assembly back to the position and draws further fluid into the liquid chamber when the gas is released; and has a piston position sensor that responds to the position of the shaft and provides signaling containing information about when the assembly is in the position or completed a stroke from the position. A gas control system includes a signal processor that receives the signaling, and provides corresponding signaling containing information about when to provide or release the gas.

28 Claims, 8 Drawing Sheets

(51) Int. Cl.

| | |
|---|---|
| ***F04B 49/03*** | (2006.01) |
| ***F04B 49/06*** | (2006.01) |
| ***F04B 43/067*** | (2006.01) |
| ***F04B 43/073*** | (2006.01) |

(52) U.S. Cl.
CPC ..... *F04B 49/03* (2013.01); *F04B 49/065* (2013.01); *F04B 7/02* (2013.01); *F04B 2201/0201* (2013.01)

(58) Field of Classification Search
USPC ..... 417/393, 395
See application file for complete search history.

(56) References Cited

U.S. PATENT DOCUMENTS

| | | | | | |
|---|---|---|---|---|---|
| 2,716,381 | A | | 8/1955 | Parker | |
| 3,299,826 | A | | 1/1967 | Williams | |
| 3,677,443 | A | | 7/1972 | Smadar et al. | |
| 3,685,554 | A | | 8/1972 | Encke | |
| 3,781,141 | A | * | 12/1973 | Schall | F01L 25/063 417/395 |
| 3,816,034 | A | * | 6/1974 | Rosenquest, Jr. | F04B 43/073 417/395 |
| 3,828,555 | A | * | 8/1974 | Capdevielle | B60K 6/12 60/413 |
| 3,898,859 | A | | 8/1975 | Duke | |
| 4,334,838 | A | * | 6/1982 | Fessler | F04B 43/0054 417/395 |
| 4,705,462 | A | * | 11/1987 | Balembois | F04B 43/06 417/395 |
| 5,069,364 | A | | 12/1991 | McGill | |
| 5,074,757 | A | | 12/1991 | Horn | |
| 5,106,275 | A | | 4/1992 | Santi et al. | |
| 5,252,041 | A | * | 10/1993 | Schumack | F04B 43/073 417/395 |
| 5,503,736 | A | | 4/1996 | Schoenmeyr | |
| 5,664,940 | A | * | 9/1997 | Du | F04B 43/0736 417/393 |
| 5,769,614 | A | | 6/1998 | Karasawa | |
| 6,452,158 | B1 | * | 9/2002 | Whatley | F15B 15/1457 250/231.13 |
| 6,790,010 | B2 | | 9/2004 | Chen et al. | |
| 6,820,765 | B2 | | 11/2004 | Pahl | |
| 6,901,844 | B2 | | 6/2005 | Djordjevic | |
| 7,074,020 | B2 | | 7/2006 | Navarro | |
| 8,636,477 | B2 | * | 1/2014 | Nagasaki | F04B 43/073 417/21 |
| 8,777,592 | B2 | * | 7/2014 | Nguyen | 417/385 |
| 2006/0027606 | A1 | | 2/2006 | Fukano et al. | |
| 2007/0177998 | A1 | * | 8/2007 | Kato | F04B 7/02 417/395 |
| 2009/0224419 | A1 | | 9/2009 | Anderson | |
| 2012/0219442 | A1 | | 8/2012 | Dong et al. | |
| 2013/0034459 | A1 | | 2/2013 | Mueller et al. | |
| 2013/0209280 | A1 | | 8/2013 | Fritsch | |

FOREIGN PATENT DOCUMENTS

| | | |
|---|---|---|
| EP | 0445231 | 9/1991 |
| EP | 0596722 | 5/1994 |
| EP | 0607687 | 7/1994 |
| EP | 1613547 | 1/2006 |
| WO | 9005697 | 5/1990 |
| WO | 9014578 | 11/1990 |
| WO | 2004091324 | 10/2004 |

* cited by examiner

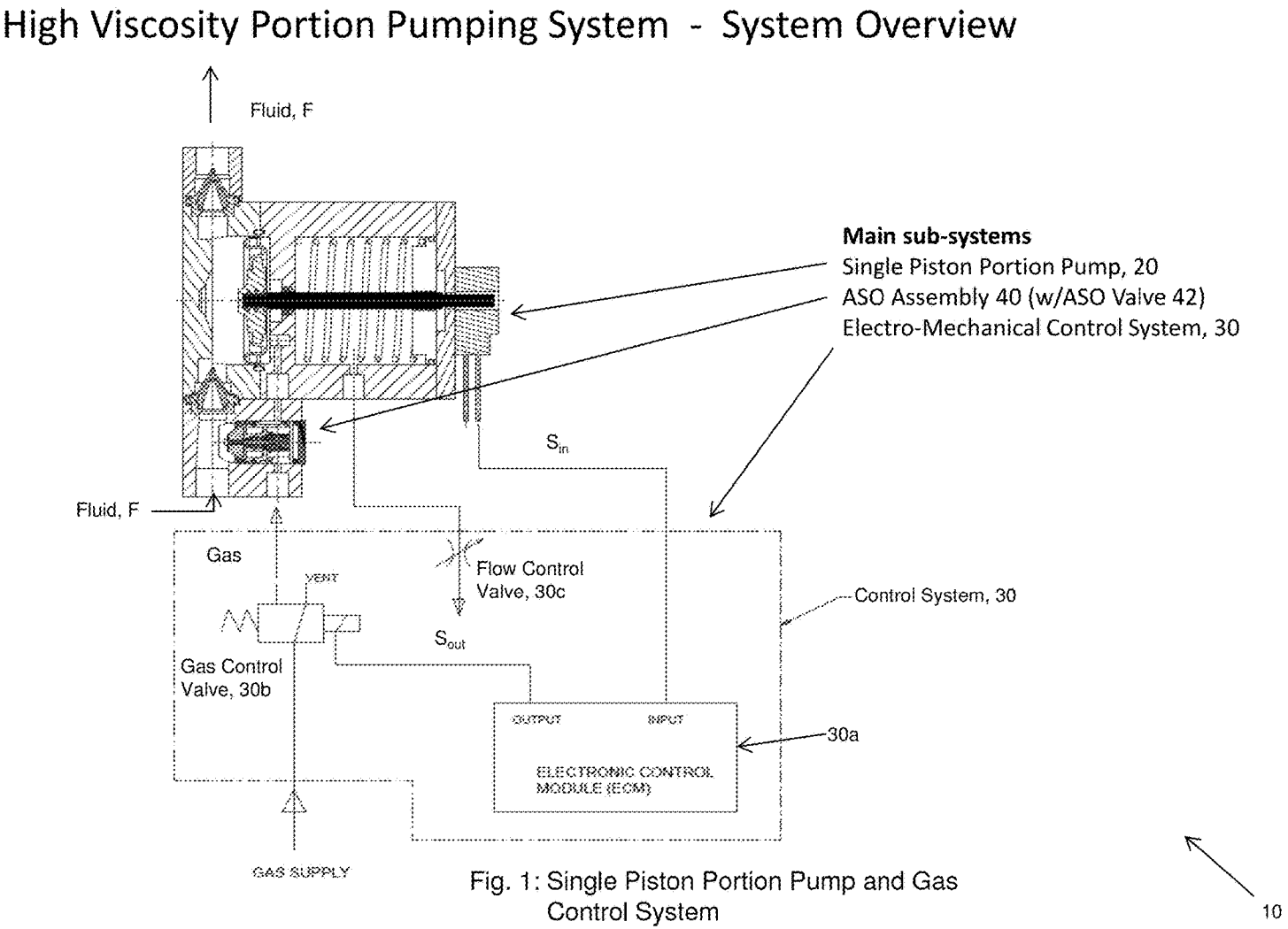
Fig. 1: Single Piston Portion Pump and Gas Control System

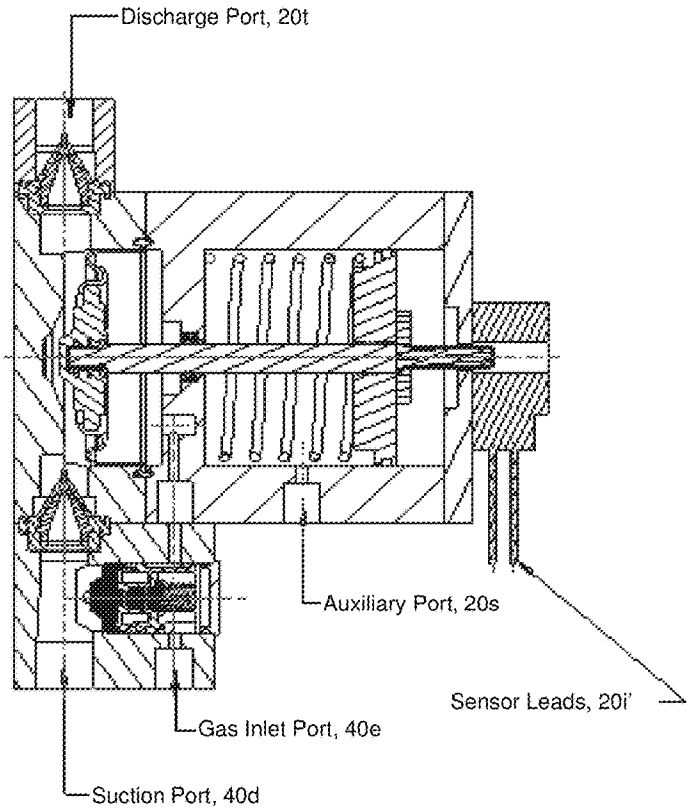
Fig. 2: Single Piston Portion Pump – Port Diagram

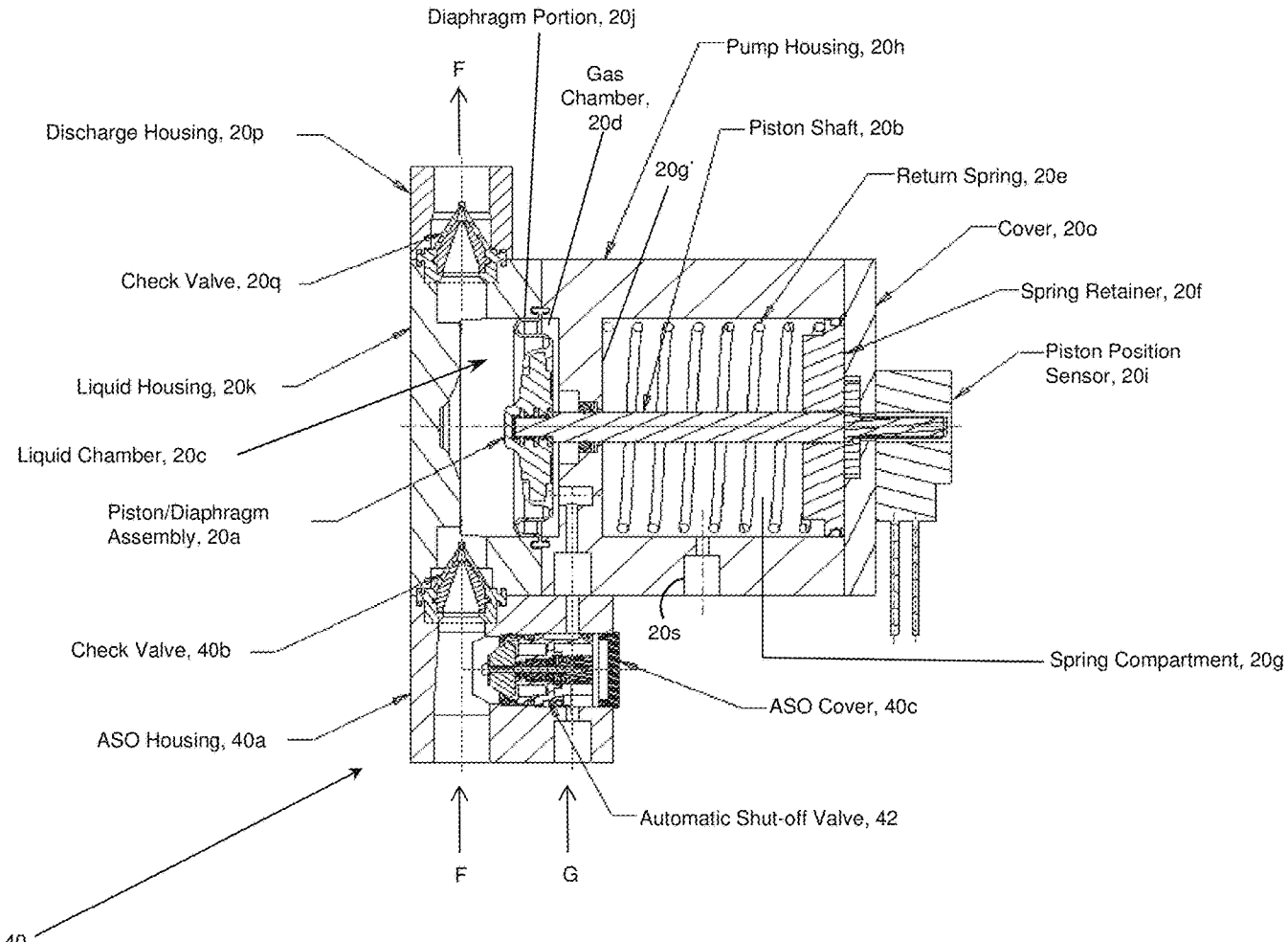
Fig. 3: Single Piston Portion Pump – Component Layout

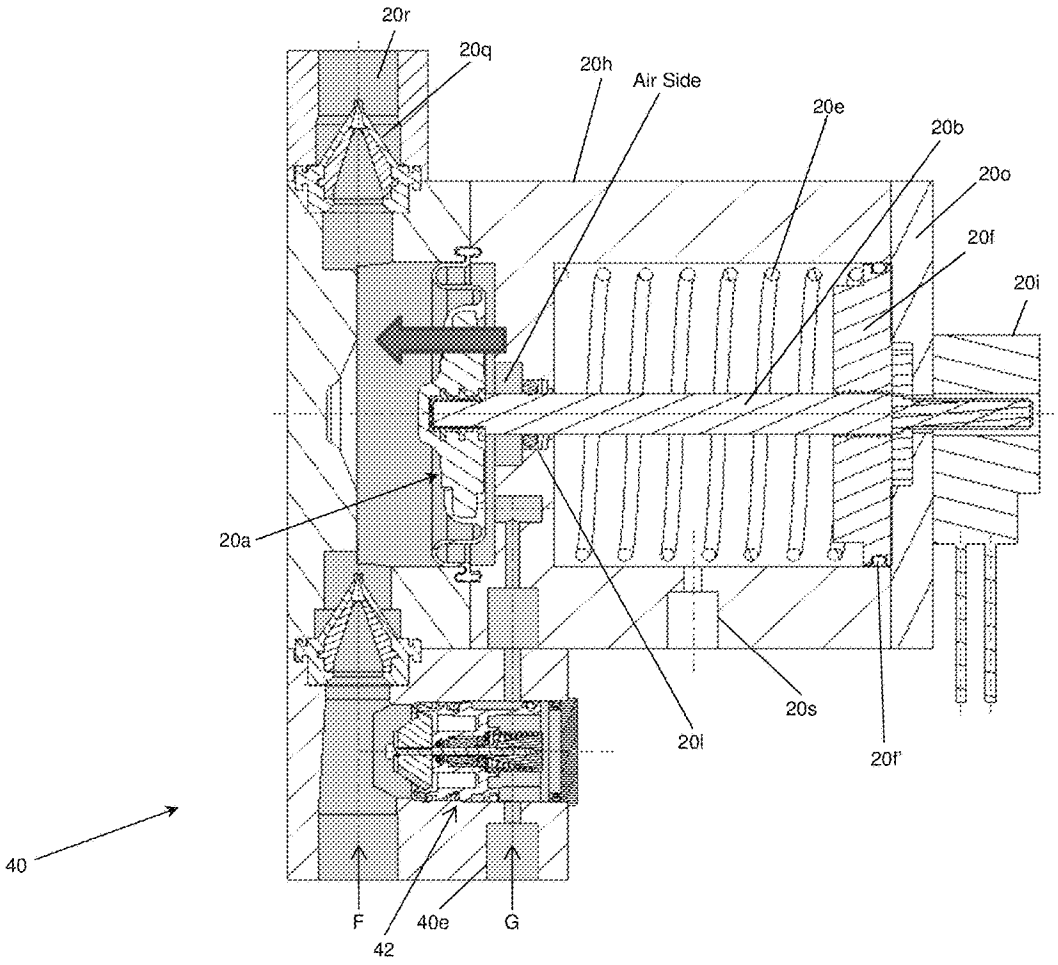
Fig. 4: High Viscosity Portion Pump Fluid Flow Paths

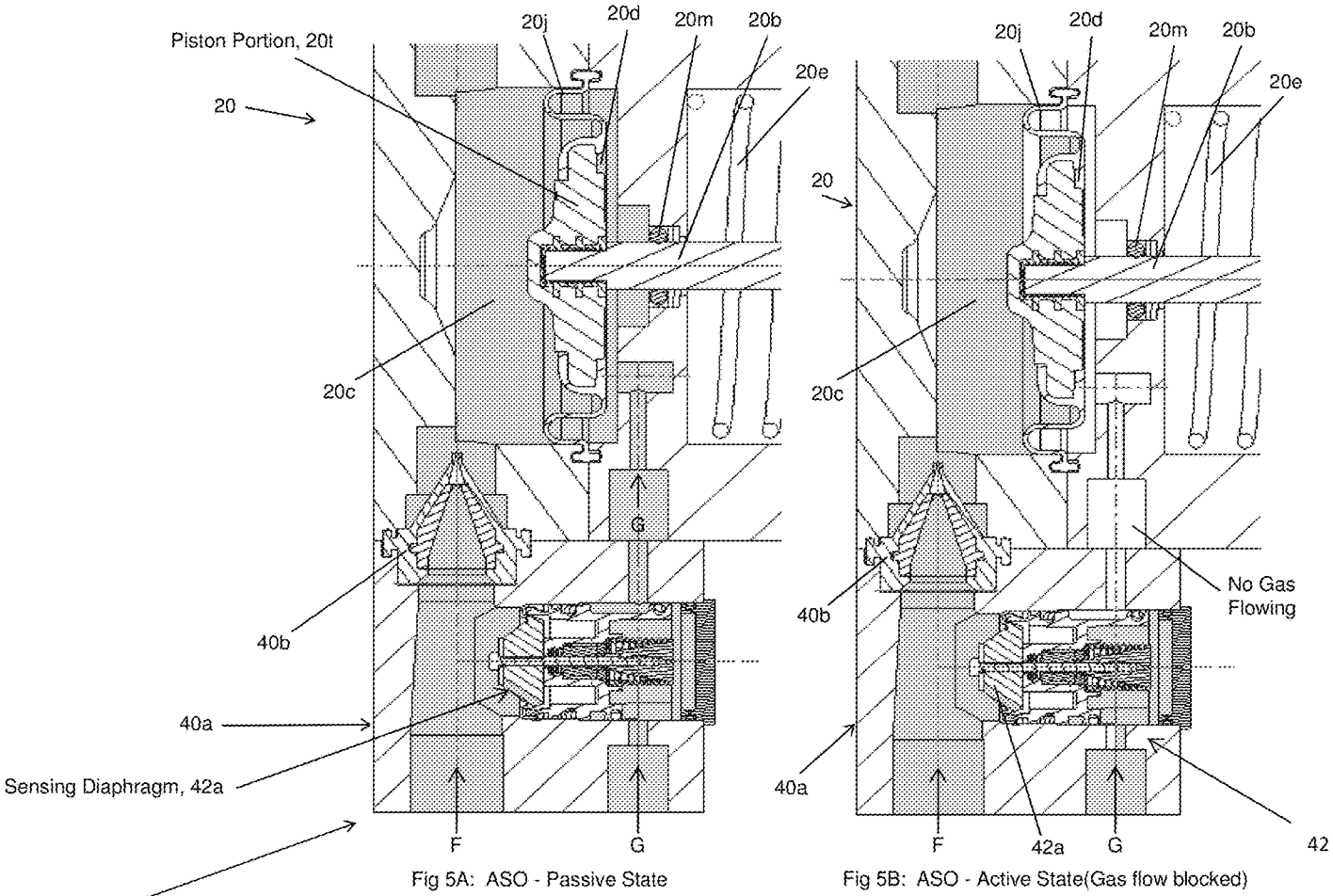
Fig 5B: ASO - Active State(Gas flow blocked)
Fig 5A: ASO - Passive State
Fig. 5: High Viscosity Portion Pump ASO Activation

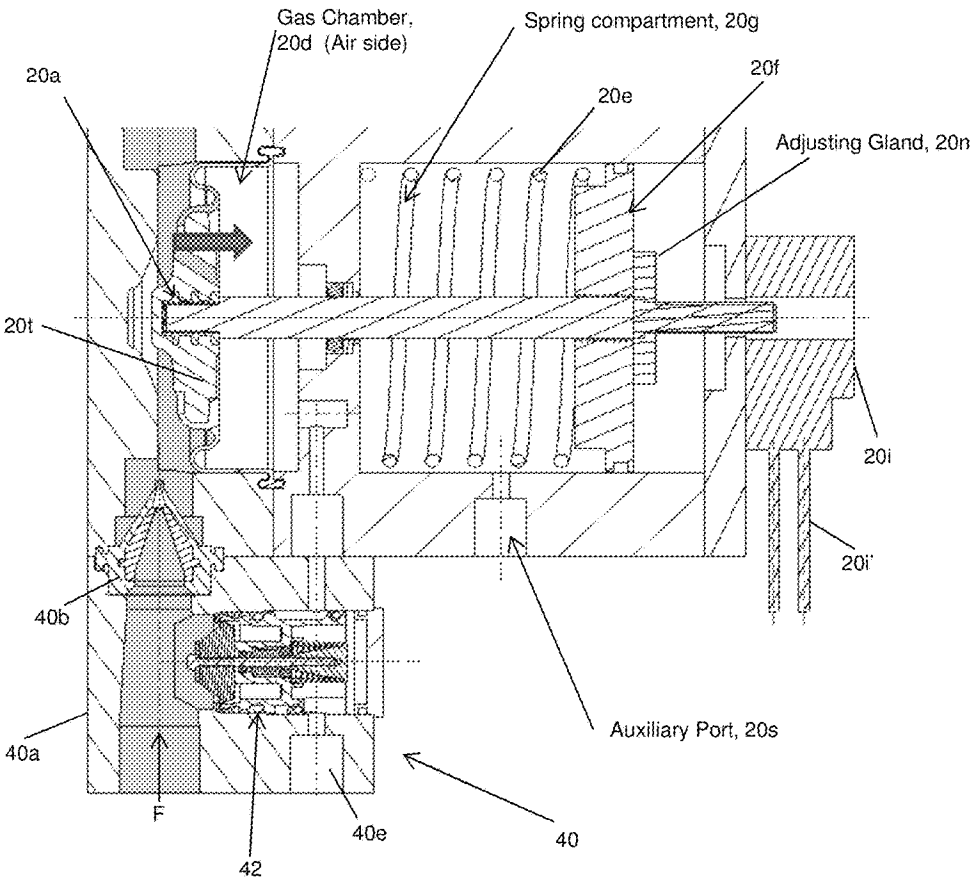
Fig. 6: High Viscosity Portion Pump Suction Stroke Control

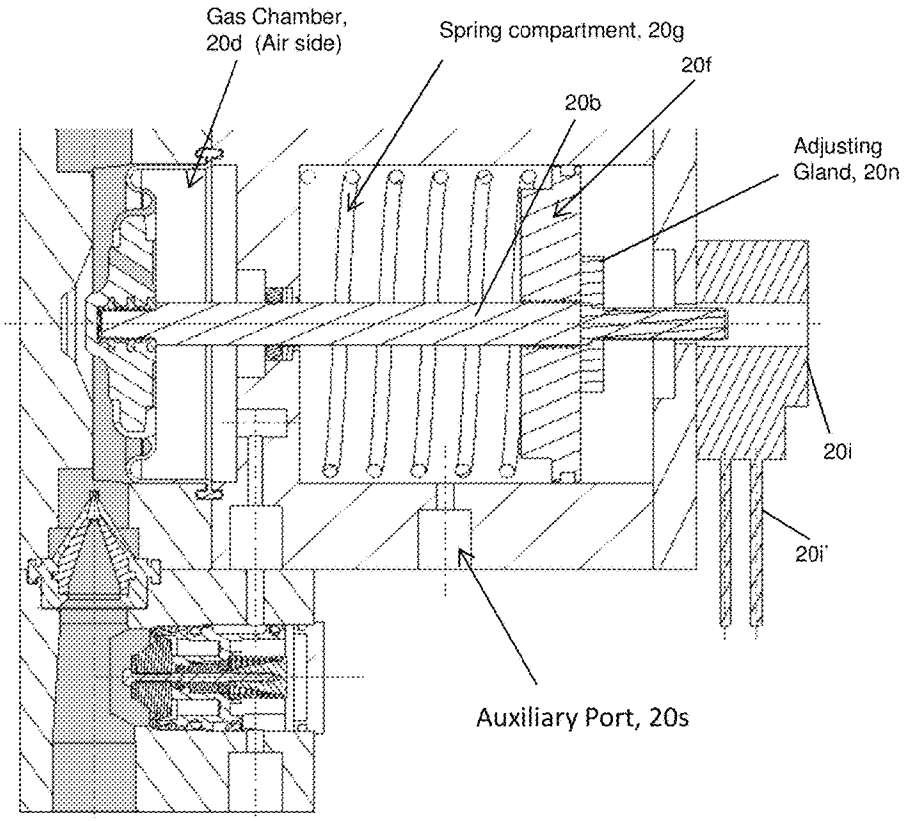
Fig. 7: High Viscosity Portion Pump Portion Control Scheme

Apparatus 100, e.g., including a gas control system like element 30,

Signal processor or processing module 30a configured at least to:

receive from a single piston portion pump signaling containing information about when a piston/diaphragm assembly is either in a starting position or has completed a stroke from the starting position, the piston/diaphragm assembly being arranged on a piston shaft and configured to form a liquid chamber and a gas chamber in the single piston portion pump that also includes a combination of an elastic member arranged on a retainer coupled to the piston shaft in a compartment in a pump housing;

determine corresponding signaling containing information about when to provide gas to the gas chamber and move the piston/diaphragm assembly from the starting position so as to cause fluid having a high viscosity to be provided from the liquid chamber, and when to release the gas from the gas chamber so as to cause the combination of the elastic member and retainer to move the piston/diaphragm assembly back to the starting position and draw further fluid into the liquid chamber; and/or provide the corresponding signaling, based upon the signaling received.

Other signal processor circuits or components 102 that do not form part of the underlying invention, e.g., including input/output modules, one or more memory modules, data, address and control busing architecture, etc.

Fig. 8

HIGH VISCOSITY PORTION PUMP

CROSS-REFERENCE TO RELATED APPLICATIONS

This application claims benefit to provisional patent application Ser. No. 61/871,903, filed 30 Aug. 2013, which is incorporated by reference in their entirety.

BACKGROUND OF THE INVENTION

1. Field of Invention

The present invention relates to a pump; and more particularly to a portion pump.

2. Description of Related Art

At the moment, there is no known method or device used to accurately portion and pump high viscosity, fluids containing particulates such as those found in dispensing beverage concentrates and 1:1 food products such as yogurts and smoothie mixes. The current method is to use a double diaphragm pump in conjunction with an air control system to dose the product, consistent with that disclosed in U.S. Pat. No. 5,664,940. Due the inherent behavior of the double diaphragm pump, the current pump's accuracy for dosing is less than adequate.

The current double diaphragm pump depends on the piston/diaphragm returning to a neutral starting position within the stroke for accuracy of the dose. The double diaphragm arrangement does not perform well due to resistive forces in the diaphragm.

SUMMARY OF THE INVENTION

According to some embodiments, and by way of example, the present invention may include, or take the form of, apparatus, such as a high viscosity portion pump system, featuring a single piston portion pump in combination with a gas control system.

The single piston portion pump may include the following:

- a piston/diaphragm assembly arranged on a piston shaft and configured to form a liquid chamber and a gas chamber, the piston/diaphragm assembly being configured to move from a starting position and cause fluid having a high viscosity to be provided from the liquid chamber in response to gas being received by the gas chamber;
- a combination of an elastic member arranged on a retainer coupled to the piston shaft in a compartment in a pump housing, the combination of the elastic member and retainer being configured to move the piston/diaphragm assembly back to the starting position and draw further fluid into the liquid chamber in response to gas being released from the gas chamber; and
- a piston position sensor configured to provide signaling containing information about when the piston/diaphragm assembly is either in the starting position or has completed a stroke from the starting position.

The gas control system may include a signal processor or signal processing control module configured to receive the signaling, and provide corresponding signaling containing information about when to provide or release the gas.

By way of example, the high viscosity portion pump system may include one or more of the following features:

The piston position sensor may be configured to sense movement and/or the position of the piston shaft and provide the signaling.

The signaling may include an electrical signal containing information when the piston/diaphragm assembly has reached the end of a pump stroke indicating that the piston/diaphragm assembly cannot travel any further and requires the gas control system to release the gas.

The piston/diaphragm assembly may include a diaphragm portion configured or arranged between a liquid housing and the pump housing so as to form the liquid chamber and the gas chamber.

The piston shaft may be configured to pass through an orifice that couples the gas chamber and the compartment, and an O-ring is configured between the piston shaft and a wall of the orifice for sealing the gas chamber and the compartment.

The elastic member may be a return spring configured between a wall of a spring compartment and a spring retainer so as to compress when the piston/diaphragm assembly moves away from the starting position and the spring retainer moves towards the wall and to expand when the piston/diaphragm assembly moves towards the starting position and the spring retainer moves away from the wall.

The single piston portion pump may include an adjusting gland arranged on the piston shaft to adjust via a screw thread arrangement the axial spring force of the return spring.

The pump housing may include a cover attached thereto having an aperture, and the piston shaft is configured to pass through the aperture in the cover in order to be sensed by the piston position sensor.

The liquid housing may include a discharge housing configured with a check valve and a discharge port to provide the fluid having the high viscosity from the liquid chamber.

The pump housing may be configured with an auxiliary port to allow the passage of air to and from the compartment when the piston/diaphragm assembly and retainer move, including allowing the compartment to be at or close to atmospheric pressure in order for displacement of the piston/diaphragm assembly and retainer.

The auxiliary port may be configured with a restriction in order to control the passage of air to and from the compartment when the piston/diaphragm assembly and the retainer move, including for providing a slower controlled rate of return of the piston/diaphragm assembly to the starting position, and also including where the restrictions takes the form of a flow control valve coupled to the auxiliary port.

The gas control system may include a gas control valve configured to respond the corresponding signaling and provide the gas.

The gas control system may include a gas control valve configured to respond the corresponding signaling and release the gas to atmosphere.

The gas control valve may be configured with a vent to release the gas received from the gas chamber.

The signal processor or signal processing control module may be configured to respond to the signaling containing information about the piston/diaphragm assembly being in the starting position, and provide the corresponding signaling containing information to provide the gas to the gas chamber.

The signal processor or signal processing control module may be configured to respond to the signaling containing information about the piston/diaphragm assembly having completed the pump stroke from the starting position, and provide the corresponding signaling containing information about releasing the gas from the gas chamber.

The signal processor or signal processing control module may be configured to respond to the signaling containing information about the position of the piston/diaphragm assembly in relation to the starting position, and provide the corresponding signaling containing information about releasing the gas from the gas chamber in order for the single piston portion pump to provide a volume of fluid less than a full pump stroke.

The signal processor or signal processing control module may be configured to implement a time sequence algorithm or technique, and provide the corresponding signaling containing information about releasing the gas from the gas chamber in order for the single piston portion pump to provide a volume of fluid less than a full pump stroke.

The high viscosity portion pump system may include an automatic shutoff assembly configured to provide the gas to the gas chamber and to provide the fluid to the liquid chamber.

The automatic shutoff assembly may include a housing configured with a suction check valve to provide the fluid to the liquid chamber. The automatic shutoff assembly may be configured with a suction port to receive the fluid to be provided, and a gas inlet port to receive the gas to be provided.

The automatic shut-off valve/assembly may be configured as a vacuum actuated gas shut-off valve to respond to a change in pressure when a suction flow path is restricted and stop the flow of the gas to the single piston portion pump, including where the automatic shut-off valve/assembly is configured to resume the gas flow when the suction flow path is not restricted.

A Single Piston Portion Pump

According to some embodiments, and by way of further example, the present invention may also include, or take the form of, a single piston portion pump, featuring the following:

- a piston/diaphragm assembly arranged on a piston shaft and configured to form a liquid chamber and a gas chamber, the piston/diaphragm assembly being configured to move from a starting position and cause fluid having a high viscosity to be provided from the liquid chamber in response to gas being received by the gas chamber;
- a combination of an elastic member arranged on a retainer coupled to the piston shaft in a compartment in a pump housing, the combination of the elastic member and retainer being configured to move the piston/diaphragm assembly back to the starting position and draw further fluid into the liquid chamber in response to gas being released from the gas chamber; and
- a piston position sensor being configured to respond to the position of the piston shaft and provide signaling containing information about when the piston/diaphragm assembly is in the starting position or has completed a stroke from the starting position.

The single piston portion pump may be configured with one or more of the features set forth herein.

The Gas Control System

According to some embodiments, and by way of further example, the present invention may also include, or take the form of, apparatus, such as a gas control system, featuring the following:

- a signal processor or signal processing control module configured to
  - receive from a single piston portion pump signaling containing information about when a piston/diaphragm assembly is either in a starting position or has completed a stroke from the starting position, the piston/diaphragm assembly being arranged on a piston shaft and configured to form a liquid chamber and a gas chamber in the single piston portion pump that also includes a combination of an elastic member arranged on a retainer coupled to the piston shaft in a compartment in a pump housing, and
  - determine corresponding signaling containing information about when to provide gas to the gas chamber and move the piston/diaphragm assembly from the starting position so as to cause fluid having a high viscosity to be provided from the liquid chamber, and when to release the gas from the gas chamber so as to cause the combination of the elastic member and retainer to move the piston/diaphragm assembly back to the starting position and draw further fluid into the liquid chamber, based upon the signaling received.

For example, the signal processor or signal processing control module may be configured to provide the corresponding signaling, including in the form of control signaling, consistent with that set forth herein.

The gas control system may be configured with one or more of the features set forth herein.

In summary, the present invention uses only one piston coupled with a large return spring to ensure that the piston returns to the same starting position each time the dose is made. In addition, other elements are incorporated to the system to adjust and control dose or amount pumped. The electronic controller can apply air for a specified time to drive the piston for a set amount in order to achieve the desire dose.

BRIEF DESCRIPTION OF THE DRAWING

The drawing includes FIGS. 1-8, which are not necessarily drawn to scale, as follows:

FIG. 1 is a block diagram of apparatus, e.g., such as a high viscosity portion pumping system, according to some embodiments of the present invention.

FIG. 2 is a diagram in cross-section of components that form part of a single piston portion pump that may form part the high viscosity portion pumping system shown in FIG. 1, having its piston/diaphragm assembly moved from a starting position, according to some embodiments of the present invention.

FIG. 3 is a diagram in cross-section of components that form part of a single piston portion pump that may form part the high viscosity portion pumping system shown in FIG. 1, having its piston/diaphragm assembly in the starting position, according to some embodiments of the present invention.

FIG. 4 is a diagram in cross-section of components that form part of a single piston portion pump that may form part the high viscosity portion pumping system shown in FIG. 1, showing gas and fluid flow paths, according to some embodiments of the present invention.

FIG. 5 includes FIGS. 5A and 5B, where FIG. 5A is a diagram in cross-section of components that form part of a single piston portion pump that may form part the high viscosity portion pumping system shown in FIG. 1, showing an Automatic Shut-Off (ASO) valve/assembly in a passive state (gas flowing), and where FIG. 5B is a diagram in cross-section of components that form part of a single piston portion pump that may form part the high viscosity portion pumping system shown in FIG. 1, showing the Automatic Shut-Off (ASO) valve/assembly in an active state (gas not flowing), according to some embodiments of the present invention.

FIG. 6 is a diagram in cross-section of components that form part of a single piston portion pump that may form part the high viscosity portion pumping system shown in FIG. 1, showing suction stroke control, according to some embodiments of the present invention.

FIG. 7 is a diagram in cross-section of components that form part of a single piston portion pump that may form part the high viscosity portion pumping system shown in FIG. 1, showing a portion control scheme, according to some embodiments of the present invention.

FIG. 8 is a block diagram of apparatus, e.g., having a signal processor or signal processing control module, according to some embodiments of the present invention.

Not every element in every Figure is labeled with a lead line and reference numeral, so as to reduce clutter in the drawing.

DETAILED DESCRIPTION OF BEST MODE OF THE INVENTION

FIGS. 1-3

FIG. 1 shows apparatus generally indicated as 10, including a high viscosity portion pump system, featuring a single piston portion pump 20 in combination with a gas control system 30. FIG. 2-3 also show the single piston portion pump 20 arranged in relation to an automatic shut-off valve/assembly 40.

By way of example, the single piston portion pump 20 may include, or be configured, the following:

A piston/diaphragm assembly 20*a* may be arranged on a piston shaft 20*b* and configured to form a liquid chamber 20*c* and a gas chamber 20*d*. The piston/diaphragm assembly 20*a* may be configured to move from a starting position and cause fluid having a high viscosity to be provided from the liquid chamber 20*c* in response to gas being received by the gas chamber 20*d*.

A combination of an elastic member 20*e* may be arranged on a retainer 20*f* coupled to the piston shaft 20*b* in a compartment 20*g* in a pump housing 20*h*. The combination of the elastic member 20*e* and retainer 20*f* may be configured to move the piston/diaphragm assembly 20*a* back to the starting position and draw further fluid into the liquid chamber 20*c* in response to gas being released from the gas chamber 20*d*.

A piston position sensor 20*i* may be configured to provide signaling $S_{in}$ containing information about when the piston/diaphragm assembly 20*a* is either in the starting position or has completed a stroke from the starting position.

The gas control system 30 may include a signal processor or signal processing control module 30*a* configured to receive the signaling $S_{in}$, and provide corresponding signaling $S_{out}$ containing information about when to provide or release the gas.

As a person skilled in the art would appreciate and understand, e.g., after reading the instant patent application in conjunction with that known in the art, the term "fluid having a high viscosity" is intended to include food products, such as yogurts and smoothie mixes, e.g., consistent with that set forth above. The scope of the invention is not intended to be limited to any particular type or kind of fluid or food product having any particular high viscosity that is either now known or later developed in the future.

By way of example, FIGS. 1, 3 and 5 show the piston/diaphragm assembly 20*a* in the starting position, and FIGS. 2, 4 and 6-7 show the piston/diaphragm assembly 20*a* away from the starting position.

By way of example, the gas may be air, although the scope of the invention is not intended to be limited to any particular type or kind of gas either now known or later developed in the future. For example, embodiments are envisioned using other types or kinds of gas than air either now known or later developed in the future.

The piston position sensor 20*i* may be configured to sense the movement and/or position of the piston shaft 20*b* and provide the signaling. By way of example, a person skilled in the art would appreciate and understanding, e.g., after reading the instant patent application in conjunction with that known in the art, how to implement a piston position sensor 20*i* without undue experimentation. By way example, the piston position sensor like element 20*i* may be configured with a sensing channel to receive an end portion of the piston shaft 20*b*, consistent with that shown in FIGS. 1-7; and the end portion of the piston shaft 20*b* may be configured with some indicia, e.g., a series of calibrated markings. In addition, the sensing channel may be configured with suitable sensors to read the calibrated markings on the end of the piston shaft 20*b*, and determine the movement and/or position of the piston shaft 20*b* based upon the indicia read. Moreover, position sensors like element 20*i* are known in the art, and the scope of the invention is not intended to be limited to any particular type or kind thereof either now known or later developed in the future.

By way of example, the signaling provided from the piston position sensor 20*i* to the signal processor or signal processing control module 30*a*, e.g. via the electrical leads 20*i*', may include an electrical signal containing information when the piston/diaphragm assembly 20*a* has reached the end of a pump stroke indicating that the piston/diaphragm assembly 20*a* cannot travel any further and requires the gas control system 30 to release the gas.

The piston/diaphragm assembly 20*a* may include a diaphragm portion 20*j* configured or arranged between a liquid housing 20*k* and the pump housing 20*h* so as to form the liquid chamber 20*c* and the gas chamber 20*d*. As shown, the diaphragm portion 20*j* may be clamped between corresponding walls of the liquid housing 20*k* and the pump housing 20*h*, although embodiment are envisioned using other types or kinds of configurations or arrangement either now known or later developed in the future.

The piston shaft 20*b* may be configured to pass through an orifice 201 that couples the gas chamber 20*d* and the compartment 20*g*, and an O-ring 20*m* may be configured between the piston shaft 20*b* and a wall of the orifice 201 for sealing the gas chamber 20*d* and the compartment 20*g*. The seal ensures that the gas provided to the gas chamber 20*d* does not leak into the compartment 20*g*, which may be in fluidic communication with the atmosphere, e.g., via the auxiliary port 20*s*.

The elastic member 20*e* may be a return spring configured between a wall 20*g*' of a spring compartment 20*g* and the spring retainer 20*f* so as to compress when the piston/diaphragm assembly 20*a* moves away from the starting position and the spring retainer 20*f* moves towards the wall 20*g*' and to expand when the piston/diaphragm assembly 20*a* moves towards the starting position and the spring retainer 20*f* moves away from the wall 20*g*'. The spring retainer 20*f* has a spring retainer O-ring 20*f*' for providing suitable sealing functionality in the compartment 20, e.g., as the spring retainer 20*f* moves therein.

The single piston portion pump 20 may include an adjusting gland 20*n* arranged on the piston shaft 20*b* to adjust, e.g. via a screw thread arrangement, the axial spring force of the return spring 20*e*. By way of example, the screw thread arrangement may include the piston shaft 20*b* having a surface with outer threads and the adjusting gland 20*n* having a bore with corresponding inner threads for rotationally coupling to the outer threads of the piston shaft 20*b*.

The pump housing 20*h* may include a cover 20*o* attached thereto having an aperture (unlabeled), and the piston shaft 20*b* may be configured to pass through the aperture in the cover 20*o* in order to be sensed by the piston position sensor 20*i*, e.g., by the sensing channel, consistent with that set forth herein and shown in FIGS. 1-7.

The liquid housing 20*k* may include a discharge housing 20*p* configured with a check valve 20*q* and a discharge port 20*r* (see FIG. 2) to provide the fluid F having the high viscosity from the liquid chamber 20*c*.

The pump housing 20*h* may be configured with the auxiliary port 20*s* to allow the passage of air to and from the spring compartment 20*g* when the piston/diaphragm assembly 20*a* and the spring retainer 20*f* move, including allowing the compartment 20*g* to be at or close to atmospheric pressure in order for displacement of the piston/diaphragm assembly 20*a* and the spring retainer 20*f*. In addition, the auxiliary port 20*s* may be configured with a restriction in order to control the passage of air to and from the compartment 20*g* when the piston/diaphragm assembly 20*a* and the spring retainer 20*f* move. By way of example, the restrictions make take the form of a flow control valve 30*c* coupled to the auxiliary port 20*s*, for providing a slower controlled rate of return of the piston/diaphragm assembly 20*a* to the starting position. Embodiment are envisioned in which the flow control valve 30*c* is coupled to the module 30*a* and controlled by the same, as well as embodiment in which the flow control valve 30*c* is not coupled to the module 30*a* and not controlled by the same. Flow control valves like element 30*c* are known in the art, and the scope of the invention is not intended to be limited to any particular type or kind thereof either now known or later developed in the future.

The gas control system 30 may include a gas control valve 30*b* configured to respond the corresponding signaling $S_{out}$ and provide the gas, e.g., to an automatic shutoff (ASO) assembly 40, which in turn provides the gas to the gas chamber 20*d*. The gas control valve 30*b* may be configured to respond the corresponding signaling $S_{out}$ and release the gas to atmosphere. For example, the gas control valve 30*b* may be configured with a vent to release the gas received from the gas chamber 20*d*.

In operation, the signal processor or signal processing control module 30*a* may be configured to respond to the signaling $S_{in}$ containing information about the piston/diaphragm assembly 20*a* being in the starting position, and provide the corresponding signaling $S_{out}$ containing information to provide the gas to the gas chamber 20*d*; and/or respond to the signaling $S_{in}$ containing information about the piston/diaphragm assembly 20*a* having completed the pump stroke from the starting position, and provide the corresponding signaling $S_{out}$ containing information about releasing the gas from the gas chamber 20*d;*

Embodiments are also envisioned in which the signal processor or signal processing control module 30*a* may be configured to respond to the signaling $S_{in}$ containing information about the position of the piston/diaphragm assembly in relation to the starting position, and provide the corresponding signaling $S_{out}$ containing information about releasing the gas from the gas chamber in order for the single piston portion pump to provide a volume of fluid less than a full pump stroke, e.g., consistent with that set forth below in relation to FIG. 7. Alternatively, the signal processor or signal processing control module 30*a* may be configured to implement a time sequence algorithm or technique, and provide the corresponding signaling containing information about releasing the gas from the gas chamber in order for the single piston portion pump to provide a volume of fluid less than a full pump stroke, e.g., consistent with that set forth below in relation to FIG. 7.

The ASO Assembly 40

The high viscosity portion pump system 10 may include the ASO assembly 40 configured to provide the gas to the gas chamber 20*d* and to provide the fluid to the liquid chamber 20*c*. The ASO assembly 40 may be configured with an automatic shut-off valve 42 that either allows gas to flow through the ASO assembly 40 or not. The ASO assembly 40 may include a housing 40*a* configured with a suction check valve 40*b* to provide the fluid to the liquid chamber 20*c*, as well as a suitable ASO cover 40*c*. The ASO assembly 40 may also be configured with a suction port 40*d* to receive the fluid to be provided, and a gas inlet port 40*e* to receive the gas to be provided, e.g., see FIGS. 2 and 5. The ASO valve 42 may include a sensing diaphragm 42*a*, e.g., which may be configured as a vacuum actuated gas shut-off valve/assembly to respond to a change in pressure, such as when a suction flow path is restricted and stops the flow of the gas to the single piston portion pump 20. The ASO assembly 40 and valve 42 may also be configured to resume the gas flow when the suction flow path is not restricted.

Automatic shutoff assemblies and valves like elements 40 and 42 are known in the art, and the scope of the invention is not intended to be limited to any particular type or kind either now known or later developed in the future. By way of example, as a person skilled in the art would appreciate and understand, especially after reading the instant patent application in conjunction with that known in the prior art, an automatic shutoff valve/assembly is typically included in a system between the fluid bag containing a product, beverage or syrup to be pumped, and the pump for pumping the product, beverage or syrup. In operation, the automatic shutoff valve/assembly will sense when the bag containing the product, beverage or syrup is empty, and stop providing gas to the pump, turning it off. When the bag is replaced with a new bag containing new beverage syrup, the system is configured to resume operation, e.g., either by a manual reset or automatically. Embodiments are envisioned within the spirit of the underlying invention both using an automatic shutoff valve/assembly like elements 40 and 42, as well as not using the same. In other words, the operability of the high viscosity portion pump system 10 re the combination of the single piston portion pump 20 and the gas control system 30 is not otherwise linked or tied per se to the use of any particular type or kind of automatic shutoff valve/assembly either now known or later developed in the future, the need to use any particular type or kind of automatic shutoff valve/assembly either now known or later developed in the future, or how any particular type or kind of automatic shutoff valve/assembly works that is either now known or later developed in the future.

FIG. 4: High Viscosity Portion Pump Fluid Flow Paths

FIG. 4 shows the high viscosity portion pump system 10 having gas and fluid flow paths that operates as follows:

1. Gas G (slightly shaded) enters the gas inlet port 40*e* and travels through the ASO 40 into the air side (i.e. into the gas chamber 20*d*) of the piston/diaphragm assembly 20*a*. The gas pressure acts on the piston/diaphragm assembly 20*a* and drives it outward (e.g., in the direction of the leftwardly pointing arrow " " as shown).

2. As the piston/diaphragm assembly 20*a* moves through the stroke, it displaces fluid out through the check valve(s) 20*q* and out the discharge port 20*p*.

3. When the piston shaft 20*b* has completed its stroke (e.g., see FIG. 5), the controller module 30*a* provides the corresponding signaling $S_{out}$ that releases the gas to atmosphere and the return spring 20*e* acts on the spring retainer 20*f* and the piston shaft 20*b* to push the piston/diaphragm assembly 20*a* towards the cover 20*o* and back to the starting position, as shown in FIG. 4.

4. While the piston/diaphragm assembly 20*a* retracts, it draws more fluid F in through the suction port 40*d* through and passed the ASO assembly 40, and into the liquid chamber 20*c*.

FIG. 5: High Viscosity Portion Pump ASO Activation

FIG. 5 includes FIG. 5A that shows the ASO assembly 40 in a passive state with gas flow to the single piston portion pump 20, and includes FIG. 5B that shows the ASO assembly 40 in an active state with gas flow blocked to the single piston portion pump 20, and operates as follows:

1. During fluid flow, product/fluid F (e.g., syrup) passes through the ASO housing 40*a* passed the sensing diaphragm 42*a*, through the check valve 40*b*, and into the liquid chamber 20*c* of the single piston portion pump 20, via a so-called suction fluid path, consistent with that shown in FIG. 5A. When the suction fluid path flow is restricted (e.g., when the bag providing the fluid is empty), pressure in the ASO housing 40*a* changes to a vacuum state. In the ASO assembly 40, the ASO valve 42 is closed in response to the vacuum state, thereby stopping the flow of gas to the air side (i.e. the gas chamber 20*d*) of the single piston portion pump 20, consistent with that shown in FIG. 5B. (As a person skilled in the art would appreciate and understand, after reading the instant patent application in conjunction with the prior art, the piston/diaphragm assembly 20*a* is a gas driven assembly that pumps in response to gas received, and stops pumping when gas is no longer received.) The ASO assembly 40 is known in the art as a so-called vacuum actuated gas shutoff valve.

2. When the fluid flow F is unrestricted or opened in the suction port 40*d*, the gas flow may be resumed through the ASO assembly 40.

FIG. 6: High Viscosity Portion Pump Suction Stroke Control

FIG. 6 shows the single piston portion pump 20 in relation to its suction stroke control, as follows:

1. During the suction stroke, the piston/diaphragm assembly 20*a* moves in the direction of the rightwardly pointing arrow "→" as shown.

2. During this phase, the gas control valve 30 (not shown in FIG. 6) has been opened to release the gas to atmosphere. (There is no gas flowing through the automatic shutoff valve 40 or to the gas chamber 20*d*, as shown). The piston/diaphragm assembly 20*a* is now subject to an axial force (leftwardly as shown) from the return spring 30*e*, e.g., by pushing against and moving the spring retainer 20*f* back towards the position shown in FIG. 4. The spring compartment 20*g* should be allowed to be at or close to atmospheric pressure in order for displacement best to occur.

3. In the event a slower controlled rate of return of the piston/diaphragm assembly 20*a* is desired/required, the pressure in the spring compartment 20*g* can be limited and controlled by way of a restriction at the auxiliary port 20*s*. Consistent with that set forth herein, and by way of example, the restriction may include, or take the form of, the flow control valve 30*c* shown in FIG. 1.

4. In addition, if more (or less) axial spring force is required, the adjusting gland 20*n* can be adjusted, e.g., via a screw thread arrangement, to compress (or relax) the return spring 20*e* for added (or lesser) axial force to the system, consistent with that set forth herein.

5. Finally, the piston position sensor 20*i* may be configured to send an electrical signal to the module 30*a* in the gas control system 30, e.g., when the piston portion 20*t* of the piston/diaphragm assembly 20*a* has reached the end of the pump stroke indicating that the piston portion 20*t* cannot travel any farther and requires the gas control system 30 to release the gas in the air side (i.e. from the gas chamber 20*d*) of the single piston portion pump 20.

FIG. 7: High Viscosity Portion Pump Portion Control Scheme

FIG. 7 shows the single piston portion pump 20 in relation to implementing a partial portion control scheme, as follows:

For example, in order for the single piston portion pump 20 to provide a volume of fluid less than the full pump stroke, the gas control system 30 (not shown in FIG. 7) may be configured, e.g., to use either a timing sequence or a position signal in order to release the gas in the air side (the gas chamber 20*d*) of the single piston portion pump 20 in order to cease fluid discharge.

By way of example, a timing sequence algorithm may be implement for executing in the module 30*a* of the gas control system 30 to drive the single piston portion pump 20 then release the gas to atmosphere, e.g., after a first predetermined period of time for providing a first type of portion of the fluid, a second predetermined period of time for providing a second type of portion of the fluid, a third predetermined period of time for providing a third type of portion of the fluid, etc. The single piston portion pump 20 and gas control system 30 may be calibrated using suitable testing to determine such timing sequences, including such periods of times for providing such associated portions, without undue experimentation, as a person skilled in the art would appreciate and understand after reading the instant patent application in conjunction with that known in the prior art.

By way of further example, a positioning algorithm may be implement for executing in the module 30*a* of the gas control system 30 to drive the single piston portion pump 20, sense the position of the piston shaft 20*b* using the piston position sensor 20*i* then release the gas to atmosphere, e.g., after sensing a first position for providing a first type of portion of the fluid, a second position for providing a second type of portion of the fluid, a third position for providing a third type of portion of the fluid, etc. The single piston portion pump 20, the gas control system 30 and the piston position sensor 20*i* may be calibrated using suitable testing to determine such sensed positions for providing such associated portions, without undue experimentation, as a person skilled in the art would appreciate and understand after reading the instant patent application in conjunction with that known in the prior art. Consistent with that set froth herein, the piston shaft 20*b* may be marked with some suitable indicia, and the movement and/or position of which may be sensed by the piston position sensor 20*i*.

FIG. 8: The Basic Signal Processor or Signal Processing Control Module

By way of example, FIG. 8 shows the present invention in the form of apparatus 100, e.g., such as the gas control system 30, having a signal processor or signal processing control module 30*a*, which may be configured at least to:

receive from a single piston portion pump such as 20 signaling containing information about when a piston/diaphragm assembly 20*a* is either in a starting position or has completed a stroke from the starting position, the piston/diaphragm assembly 20*a* being arranged on a piston shaft 20*b* and configured to form a liquid chamber 20*c* and a gas chamber 20*d* in the single piston portion pump 20 that also includes a combination of an elastic member 20*e* arranged on a retainer 20*f* coupled to the piston shaft 20*b* in a compartment 20*g* in a pump housing 20*h*, and provide corresponding signaling containing information about when to provide gas to the gas chamber 20*d* to move the piston/diaphragm assembly 20*a* from the starting position and provide fluid F having a high viscosity from the liquid chamber 20*c*, and when to release the gas from the gas chamber 20*d* so as to cause the combination of the elastic member 20*e* and retainer 20*f* to move the piston/diaphragm assembly 20*a* back to the starting position and draw further fluid into the liquid chamber 20*c*, based upon the signaling received.

The signal processor or signal processing control module 30*a* may also be configured to provide the corresponding signaling $S_{out}$, including in the form of control signaling, consistent with that set forth herein.

The scope of the invention is intended to include the apparatus taking the form of the signal processor or signal processing control module 30*a* alone, as well as signal processor or signal processing control module 30*a* forming part of apparatus like the gas control system 30.

Signal Processor 30*a*

By way of example, and consistent with that described herein, the functionality of the signal processor, device or module 30*a* may be implemented to receive the signaling, process the signaling therein and/or provide the corresponding signaling, e.g., using hardware, software, firmware, or a combination thereof, although the scope of the invention is not intended to be limited to any particular embodiment thereof. In a typical software implementation, the signal processor, device or module 30*a*, may include, or take the form of, one or more microprocessor-based architectures having a microprocessor, a random access memory (RAM), a read only memory (ROM), input/output devices and control, data and address busing architecture connecting the same. A person skilled in the art would be able to program such a microprocessor-based implementation to perform the functionality set forth herein, as well as other functionality described herein without undue experimentation. The scope of the invention is not intended to be limited to any particular implementation using technology either now known or later developed in the future. Moreover, the scope of the invention is intended to include a signal processor as either part of the aforementioned apparatus, as a stand alone module, or in the combination with other components and/or circuitry for implementing another module.

By way of example, techniques for receiving signaling in such a signal processor, device, module 30*a* are known in the art, and the scope of the invention is not intended to be limited to any particular type or kind thereof either now known or later developed in the future. Based on this understanding, a person skilled in the art would appreciate, understand and be able to implement and/or adapt the signal processor, device, module 30*a* without undue experimentation so as to receive the signaling containing information about when a piston/diaphragm assembly 20*a* is either in a starting position or has completed a stroke from the starting position, the piston/diaphragm assembly 20*a* being arranged on a piston shaft 20*b* and configured to form a liquid chamber 20*c* and a gas chamber 20*d* in the single piston portion pump 20 that also includes a combination of an elastic member 20*e* arranged on a retainer 20*f* coupled to the piston shaft 20*b* in a compartment 20*g* in a pump housing 20*h*, consistent with that set forth herein.

Techniques for determining one type of signaling from another type signaling received are also known in the art, and the scope of the invention is not intended to be limited to any particular type or kind thereof either now known or later developed in the future. Based on this understanding, a person skilled in the art would appreciate, understand and be able to implement and/or adapt the signal processor, device, module 30*a* without undue experimentation so as to determine signaling containing information about when to provide gas to the gas chamber to move the piston/diaphragm assembly from the starting position and provide fluid F having a high viscosity from the liquid chamber 20*c*, and when to release the gas from the gas chamber 20*d* so as to cause the combination of the elastic member 20*e* and retainer 20*f* to move the piston/diaphragm assembly 20*a* back to the starting position and draw further fluid into the liquid chamber 20*c*, based upon the signaling received.

Techniques for providing signaling from a signal processor such as module 30*a* are also known in the art, and the scope of the invention is not intended to be limited to any particular type or kind thereof either now known or later developed in the future. Based on this understanding, a person skilled in the art would appreciate, understand and be able to implement and/or adapt the signal processor, device, module 30*a* without undue experimentation so as to provide signaling containing information about when to provide gas to the gas chamber 20*d* to move the piston/diaphragm assembly 20*a* from the starting position and provide fluid F having a high viscosity from the liquid chamber 20*c*, and when to release the gas from the gas chamber 20*d* so as to cause the combination of the elastic member 20*e* and retainer 20*f* to move the piston/diaphragm assembly 20*a* back to the starting position and draw further fluid into the liquid chamber 20*c*, consistent with that set forth herein.

It is also understood that the apparatus 100 may include one or more other modules, components, processing circuits, or circuitry 102 for implementing other functionality associated with the underlying apparatus that does not form part of the underlying invention, and thus is not described in detail herein. By way of example, the one or more other modules, components, processing circuits, or circuitry may include random access memory, read only memory, input/output circuitry and data and address buses for use in relation to implementing the signal processing functionality of the signal processor, or devices or components, etc.

The Scope of the Invention

While the invention has been described with reference to an exemplary embodiment, it will be understood by those skilled in the art that various changes may be made and equivalents may be substituted for elements thereof without departing from the scope of the invention. In addition, may modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. Apparatus comprising:

a single piston portion pump having a piston/diaphragm assembly arranged on a piston shaft and configured to form a liquid chamber and a gas chamber, the piston/diaphragm assembly being configured to move from a starting position and cause fluid having a high viscosity to exit from the liquid chamber in response to gas being received by the gas chamber, a combination of an elastic member arranged on a retainer coupled to the piston shaft, the combination of the elastic member and retainer being configured to move the piston/diaphragm assembly back to the starting position and draw further fluid into the liquid chamber in response to gas being released from the gas chamber, a piston position sensor configured to provide signaling containing information about when the piston/diaphragm assembly is either in the starting position or has completed a stroke from the starting position; and a compartment in a pump housing formed between the retainer and a wall of the compartment, wherein the elastic member is configured in the compartment between the retainer and the wall and the compartment comprises an auxiliary port to allow the passage of air to and from the compartment when the piston/diaphragm assembly and retainer move; and a gas control system having a signal processor or signal processing control module configured to receive the signaling, and provide corresponding signaling containing information about when to provide or release the gas to or from the gas chamber of the piston/diaphragm assembly, the gas control system having a gas control valve configured to respond to the corresponding signaling, and provide the gas for a specified time to drive the piston shaft for a set amount in order to achieve a desired dose of the fluid;

wherein the auxiliary port is configured to allow the compartment to be at or close to atmospheric pressure in order for displacement of the piston/diaphragm assembly and retainer; and wherein the auxiliary port is configured with a restriction in order to control the passage of air to and from the compartment when the piston/diaphragm assembly and the retainer move, including for providing a slower controlled rate of return of the piston/diaphragm assembly to the starting position, and also including where the restriction takes the form of a flow control valve coupled to the auxiliary port.

2. An apparatus comprising:

a single piston portion pump having a piston/diaphragm assembly arranged on a piston shaft and configured to form a liquid chamber and a gas chamber, the piston/diaphragm assembly being configured to move from a starting position and cause fluid having a high viscosity to exit from the liquid chamber in response to gas being received by the gas chamber, a combination of an elastic member arranged on a retainer coupled to the piston shaft, the combination of the elastic member and retainer being configured to move the piston/diaphragm assembly back to the starting position and draw further fluid into the liquid chamber in response to gas being released from the gas chamber, a piston position sensor configured to provide signaling containing information about when the piston/diaphragm assembly is either in the starting position or has completed a stroke from the starting position; and a compartment in a pump housing formed between the retainer and a wall of the compartment, wherein the elastic member is configured in the compartment between the retainer and the wall and the compartment comprises an auxiliary port to allow the passage of air to and from the compartment when the piston/diaphragm assembly and retainer move; and a gas control system having a signal processor or signal processing control module configured to receive the signaling, and provide corresponding signaling containing information about when to provide or release the gas to or from the gas chamber of the piston/diaphragm assembly, the gas control system having a gas control valve configured to respond to the corresponding signaling, and provide the gas for a specified time to drive the piston shaft for a set amount in order to achieve a desired dose of the fluid;

wherein the auxiliary port comprises a flow control valve configured to control the passage of air to and from the compartment when the piston/diaphragm assembly and the retainer move.

3. Apparatus according to claim 2, wherein the flow control valve of the auxiliary port is configured to control pressure in the compartment and adjust a rate of return to of the piston/diaphragm assembly to the starting position.

4. Apparatus according to claim 2, wherein the flow control valve of the auxiliary port is coupled to and controlled by the signal processing control module.

5. Apparatus according to claim 2, wherein the piston/diaphragm assembly is configured to displace the fluid in the liquid chamber and allow air to pass from the compartment through the auxiliary port when the piston/diaphragm assembly moves away from the starting position.

6. Apparatus according to claim 5, wherein movement of the piston/diaphragm assembly towards the starting position is configured to cause fluid to be drawn into the liquid chamber and air to pass into the compartment through the auxiliary port.

7. Apparatus according to claim 2, wherein the retainer comprises a retainer O-ring configured to provide a seal of the compartment as the retainer moves therein.

8. Apparatus according to claim 2, wherein the piston position sensor comprises a sensing channel configured to receive an end portion of the piston shaft.

9. Apparatus according to claim 8, wherein the end portion of the piston shaft comprises indicia and the sensing channel comprises one or more sensors is configured to read the indicia on the end of the piston shaft and determine the movement and position of the piston shaft.

10. Apparatus according to claim 9, wherein the indicia comprise a series of calibrated markings.

11. Apparatus according to claim 2, wherein the piston position sensor is configured to sense movement and/or the position of the piston shaft and provide the signaling.

12. Apparatus according to claim 2, wherein the signaling includes an electrical signal containing information when the piston/diaphragm assembly has reached the end of a pump stroke indicating that the piston/diaphragm assembly cannot travel any further and requires the gas control system to release the gas.

13. Apparatus according to claim 2, wherein the piston/diaphragm assembly comprises a diaphragm portion configured or arranged between a liquid housing and the pump housing so as to form the liquid chamber and the gas chamber.

14. Apparatus according to claim 13, wherein the diaphragm portion is clamped between walls of the liquid chamber and the gas chamber.

15. Apparatus according to claim 2, wherein the piston shaft is configured to pass through an orifice that couples the gas chamber and the compartment, and an O-ring is configured between the piston shaft and a wall of the orifice for sealing the gas chamber and the compartment.

16. Apparatus according to claim 2, wherein the elastic member is a return spring configured between the wall of the compartment and the retainer so as to compress when the piston/diaphragm assembly moves away from the starting position and the retainer moves towards the wall and to expand when the piston/diaphragm assembly moves towards the starting position and the retainer moves away from the wall.

17. Apparatus according to claim 16, wherein the single piston portion pump includes an adjusting gland arranged on the piston shaft to adjust via a screw thread arrangement the axial spring force of the return spring.

18. Apparatus according to claim 11, wherein the pump housing includes a cover attached thereto having an aperture, and the piston shaft is configured to pass through the aperture in the cover in order to be sensed by the piston position sensor.

19. Apparatus according to claim 2, wherein the liquid housing includes a discharge housing configured with a check valve and a discharge port to provide the fluid having the high viscosity from the liquid chamber.

20. Apparatus according to claim 2, wherein the auxiliary port is configured to allow the compartment to be at or close to atmospheric pressure in order for displacement of the piston/diaphragm assembly and retainer.

21. Apparatus according to claim 2, wherein the signal processor or signal processing control module is configured to respond to the signaling containing information about the piston/diaphragm assembly being in the starting position, and provide the corresponding signaling containing information to provide the gas to the gas chamber.

22. Apparatus according to claim 2, wherein the signal processor or signal processing control module is configured to respond to the signaling containing information about the piston/diaphragm assembly having completed the pump stroke from the starting position, and provide the corresponding signaling containing information about releasing the gas from the gas chamber.

23. Apparatus according to claim 11, wherein the signal processor or signal processing control module is configured to respond to the signaling containing information about the position of the piston/diaphragm assembly in relation to the starting position, and provide the corresponding signaling containing information about releasing the gas from the gas chamber in order for the single piston portion pump to provide a volume of fluid less than a full pump stroke.

24. Apparatus according to claim 2, wherein the signal processor or signal processing control module is configured to implement a time sequence algorithm or technique, and provide the corresponding signaling containing information about releasing the gas from the gas chamber in order for the single piston portion pump to provide a volume of fluid less than a full pump stroke.

25. Apparatus according to claim 2, further comprising an automatic shutoff assembly configured to provide the gas to the gas chamber and to provide the fluid to the liquid chamber.

26. Apparatus according to claim 25, wherein the automatic shutoff assembly comprises a housing configured with a suction check valve to provide the fluid to the liquid chamber.

27. Apparatus according to claim 25, wherein the automatic shutoff assembly is configured with a suction port to receive the fluid to be provided, and a gas inlet port to receive the gas to be provided.

28. Apparatus according to claim 25, wherein the automatic shut-off valve/assembly is configured as a vacuum actuated gas shut-off valve/assembly to respond to a change in pressure when a suction flow path is restricted and stop the flow of the gas to the single piston portion pump, including where the automatic shut-off valve/assembly is configured to resume the gas flow when the suction flow path is not restricted.

* * * * *